US008735320B2

(12) United States Patent
La Costa

(10) Patent No.: US 8,735,320 B2
(45) Date of Patent: May 27, 2014

(54) METHOD OF TRANSFER PRINTING USING WHITE TONER

(76) Inventor: Alfred W. La Costa, Pittstown, NJ (US)

( * ) Notice: Subject to any disclaimer, the term of this patent is extended or adjusted under 35 U.S.C. 154(b) by 70 days.

(21) Appl. No.: 13/539,381

(22) Filed: Jun. 30, 2012

(65) Prior Publication Data

US 2013/0004742 A1 Jan. 3, 2013

Related U.S. Application Data

(60) Provisional application No. 61/571,774, filed on Jul. 1, 2011, provisional application No. 61/571,957, filed on Jul. 8, 2011.

(51) Int. Cl.

| | |
|---|---|
| ***B41M 5/382*** | (2006.01) |
| ***B41M 3/12*** | (2006.01) |
| ***B41M 5/025*** | (2006.01) |
| ***B41M 5/035*** | (2006.01) |
| ***B44C 1/17*** | (2006.01) |

(52) U.S. Cl.
USPC ..... 503/227; 156/235; 427/152

(58) Field of Classification Search
CPC ..... B41M 3/12; B41M 2205/02; B41M 2205/10; B41J 2/0057; B44C 1/17; G03G 15/1625; G03G 15/6591
USPC ..... 503/227; 156/235; 427/152
See application file for complete search history.

(56) References Cited

U.S. PATENT DOCUMENTS 6,369,843 B1 * 4/2002 Springett et al. ..... 347/173

* cited by examiner

*Primary Examiner* — Bruce H Hess
(74) *Attorney, Agent, or Firm* — Bradford W. Bondor

(57) ABSTRACT

A novel method of transfer printing onto articles, particularly dark articles, is disclosed. A design, preferably in color, is printed onto a transfer sheet in sublimation dye using a commercially-available printer. White toner is then printed over at least a portion of the design using an electrostatic printing device. Heat and pressure are applied to transfer the design and the white toner to an article. In some preferred embodiments, the transfer sheet is a self-weeding transfer paper. In some preferred embodiments, the same printer is used to print both the sublimation dye design and the white toner. In some preferred embodiments, the color palette of the image is inverted prior to printing with white toner. The invention is particularly well suited to the transfer printing of dark textile articles.

19 Claims, 4 Drawing Sheets

METHOD OF TRANSFER PRINTING USING WHITE TONER

CROSS-REFERENCE TO RELATED APPLICATIONS

This application claims the benefit of provisional application 61/571,774 to Alfred W. La Costa, titled "Heat transfer to dark shirts with a laser or LED color printer, sublimation dye toners, 2 formulas of white toner 2nd & self weeding coated transfer paper," filed Jul. 1, 2011. This application claims the benefit of provisional application 61/571,957 to Alfred W. La Costa, titled "Heat transfer to dark apparel with a ink jet color printer with sublimation ink, 2 white toner formulas for a laser/LED printer and a self weeding coated transfer paper," filed Jul. 8, 2011.

BACKGROUND OF THE INVENTION

1. Field of the Invention

This application relates to producing images on a surface, and more specifically relates to transfer printing using sublimation dye, white toner, and weed-free paper.

2. Description of Related Art

Transfer printing involves temporarily creating an image on a first surface, and then transferring that image to a second surface. Transfer printing is used to apply designs to an almost unlimited variety of objects. One field in particular which has seen a large growth in transfer printing over the course of the 20th Century is the transfer printing of textiles. Tee shirts with preprinted designs have become very popular among consumers, and technologies have been developed to assist in the creation of such shirts. With the advent of home computing and improvements in printing technology, consumers can now make their own designs on transfer paper and apply them to a surface using a clothes iron.

It has been found that sublimation dyes and disperse dyes used in transfer printing provide a superior transfer as compared to traditional pigments. Sublimation dyes, as the name suggests, change directly from a solid phase to a gaseous phase upon heating. When used in transfer printing articles, sublimation dyes can provide bold and vivid colors, that have a better "hand" or feel than prints made from traditional pigments, and have a better wash-fastness. Sublimation dyes adhere very well to synthetic materials such as polyester, but do not work as well with natural materials such as cotton. In some cases, inventors have attempted to improve the application of sublimation dyes to natural materials such as cotton by creating transfer media specifically designed for that purpose.

U.S. Pat. No. 4,021,591 to DeVries et al. discloses a dry release sublimation transfer which includes a temporary backing sheet having disposed thereon a sublimation transfer design layer formed of one or more sublimation transfer inks, and a polymeric coating disposed in contact with such design layer. In one embodiment, the design layer is first printed on the backing sheet employing conventional printing techniques and thereafter the polymeric coating is applied over the design layer. In another embodiment, the polymeric coating is first applied to the backing sheet and thereafter the design layer is printed over the polymeric coating. The dry release sublimation transfer is applied under heat and pressure to a substrate to be decorated, such as cotton fabric or a cotton-polyester fabric, thereby causing the polymeric coating to soften and penetrate into the substrate and upon cooling securely bond the design layer to the substrate. In addition, a method for decorating a substrate employing the above-described dry release sublimation transfer is provided.

U.S. Pat. No. 4,172,418 to Durand describes a method and apparatus for effecting sublimation printing of a substrate wherein a matrix comprising the design to be printed is electrostatically charged in a given polarity and then a fine disperse dye powder, oppositely charged, is brought into contact with said matrix wherein the charged matrix attracts the oppositely charged dye particles to effect coating of the matrix with the dye, after which the coated matrix is moved into registry with the substrate to be printed, and specifically in overlying relation with respect to a surface of the substrate that has been coated with a dye receptive coating, after which the matrix is brought into pressurized contact with the coated surface of the substrate to cause sublimation of the dye pattern into said coated substrate surface.

U.S. Pat. No. 4,576,610 to Donenfeld discloses an improved method for sublimation dye transfer printing of a sublimable dye onto fabric by applied heat, comprising applying a composition comprising a polyester resin to the fabric, in which the polyester resin chemically bonds the dye to the fabric, to yield a fabric having a soft hand and deep color which is fast through repeated laundering. In preferred embodiments, the polyester resin has free carboxyl groups. In another embodiment, a conventional dye binder is also applied to the fabric. In a further modification, metallic glitter is added to the dye. The present invention also provides dye bonding compositions for bonding sublimable dues to fabrics, and sublimation dye transfer printing elements incorporating the compositions of the invention.

It has been found that when transfer printing to a dark article, for example transfer printing onto black fabric, the image can be obscured by the dark article. Attempts have been made by inventors to overcome this problem by providing a background against which the transferred design can stand out.

U.S. Pat. No. 4,773,953 to Hare describes a method for creating personalized, creative designs or images on a fabric such as a tee shirt or the like using a personal computer system. The design is first created by hand on the monitor screen of the computer system. The design so created is then printed onto a heat transfer sheet. The design is then ironed onto the fabric or tee shirt. The design may also be an image, such as a picture created by a video camera.

U.S. Pat. No. 5,642,141 to Hale et al. discloses a method of printing a liquid ink which is produced from a heat activated dye which is selected from a limited group of dyes which are capable of transfer at low energy. A printer which uses liquid ink, such as an ink jet printer, prints an image onto an intermediate substrate medium. The dyes contained in the ink are not substantially activated during the process of printing on to the medium. The image formed by the printed ink is transferred from the medium to a final substrate by the application of heat and pressure for a short period of time to activate the ink. The dye and dispersing/emulsifying agent(s) are selected from a limited group to produce an ink which permits thermal transfer at low energy, with the resulting image, as deposited on the final substrate, having an optical density of 1.0 or greater.

U.S. Pat. No. 5,734,396 to Hale et al. discloses a transfer sheet capable of applying a colored pattern to a final support material through the application of heat and pressure. The transfer sheet includes a carrier sheet having a colored pattern printed on the surface thereof. A digitally controlled color printer is used to print a colored pattern on the surface of the carrier sheet. A layer of white colored material is printed over at least the color pattern with a digitally controlled color printer. A layer of glue is deposited over the layer of white colored material. The layer of glue may also be printed over the white colored material by the digitally controlled color printer, or by a separate device, if required.

U.S. Pat. No. 6,369,843 B1 to Springett et al. discloses a transfer sheet capable of applying a colored pattern to a final support material through the application of heat and pressure. The transfer sheet includes a carrier sheet having a colored pattern printed on a surface thereof. A digitally controlled color printer is used to print a colored pattern on the surface of the carrier sheet. A layer of white colored material is printed over at least the color pattern with a digitally controlled color printer. A layer of glue is deposited over the layer of white colored material. The layer of glue may also be printed over the white colored material by the digitally controlled color printer, or by a separate device, if required.

United States Published Patent Application No. 2002/0047889 to Springett et al. discloses a transfer sheet capable of applying a colored pattern to a final support material through the application of heat and pressure. The transfer sheet includes a carrier sheet having a colored pattern printed on a surface thereof. A digitally controlled color printer is used to print a colored pattern on the surface of the carrier sheet. A layer of white colored material is printed over at least the color pattern with a digitally controlled color printer. A layer of glue is deposited over the layer of white colored material. The layer of glue may also be printed over the white colored material by the digitally controlled color printer, or by a separate device, if required.

U.S. Pat. No. 6,409,330 B1, to Nakamura et al. discloses an ink composition which can satisfy, on a high level, various property requirements for ink compositions for use in ink jet recording (e.g., excellent ejection stability and realization of images free from feathering or color-to-color bleeding) and can realize good images by sublimation transfer. A sublimation transfer ink jet recording method using the ink composition is also disclosed. The ink composition comprises a heat transferable dye, a glycol ether, an acetylene glycol surfactant, and water. This ink composition is printed by ink jet recording onto an intermediate transfer medium to form a latent image on the intermediate transfer medium, and the intermediate transfer medium is then put on the surface of a receptor object, followed by heating of the intermediate transfer medium at a sufficient temperature and for a sufficient time to sublimate the heat transferrable dye and to deposit the sublimated dye onto the surface of the receptor object. This recording method can realize good transferred images suffering from minimized bleeding.

U.S. Pat. No. 6,486,903 B1 to Wagner et al. discloses that a coated media is printed with ink. The area of the media which is not covered with ink is cured by exposure to radiation, and the printed image is transferred to a final substrate. The media is coated with a radiation curable coating. Upon exposure to electron beam or ultraviolet radiation, the coating in the exposed, non-imaged, area cures, and becomes permanently bonded to the base sheet. The ink layer of the imaged area effectively blocks, absorbs and/or reflects the radiation and does not allow polymerization under the imaged area. The image is transferred to a final substrate by placing the image in contact with the final substrate, followed by the application of energy. The image is permanently bonded to the final substrate. No overprint, or non-imaged area, that is visible or which may be felt by touching, is transferred to the final substrate.

U.S. Pat. No. 6,488,370 B2 to Hale et al. discloses a method of producing a printed a by printing heat activated ink solids in a non activated form onto a medium in a desired image by means of an ink jet printer. The invention is printed using ink or dye compositions comprising heat activated ink or dye solids. The ink compositions used to print the medium are solid at ambient temperature when used with phase change ink jet printers, and are emulsions when used with liquid ink jet printers such as free flow and bubble jet printers. The dye solids are printed in the desired design by means of a printer onto a substrate, which becomes the printed medium. The substrate may be paper, or it may be other material.

U.S. Pat. No. 6,618,066 B2 to Hale et al. discloses an image that is printed on a substrate by means of a computer driven ink jet printer using heat activated dye, without activating the dye during the process of printing onto the substrate. The individual solid dye particles are present in a liquid ink, and are stabilized in the ink by an emulsifying enforcing agent that emulsifies the solid dye particles within the ink. The dye is subsequently activated by applying sufficient heat and pressure to the substrate to activate the dyes and permanently bond the image to a final substrate. The resulting permanent image is resistant to laundering.

U.S. Pat. No. 6,966,643 B2 to Hale et al. discloses an image that is printed on a substrate by means of a computer driven printer using heat activated dyes, without activating the dyes during the process of printing onto the substrate. The dyes are subsequently activated by applying sufficient heat and pressure to the substrate to activate the dyes.

U.S. Reissued Pat. No. RE38,952 E to Hale et al. discloses [A method of printing a liquid ink which is produced from a heat activated dye which is selected from a limited group of dyes which are capable of transfer at low energy. A printer which uses liquid ink, such as an ink jet printer, prints an image onto an intermediate substrate medium. The dyes contained in the ink are not substantially activated during the process of printing on to the medium. The image formed by the printed ink is transferred from the medium to a final substrate by the application of heat and pressure for a short period of time to activate the ink. The dye and dispersing/emulsifying agent(s) are selected from a limited group to produce an ink which permits thermal transfer at low energy, with the resulting image, as deposited on the final substrate, having an optical density of 1.0 or greater.] Liquid ink is produced using heat activated dyes selected from a limited group of dyes that are capable of heat activation. The dyes are not substantial soluble in the liquid carrier, such as water. One or more emulsifying agents stabilize the ink formulation. A printer that uses liquid ink, such as an ink jet printer, is used to print the ink, and dye is heat activated after printing.

U.S. Pat. No. 7,041,424 B2 to Xu et al. discloses reactive toners which are printed by electrophotographic and electrographic printers. One or more of the toners may include reactive components. An additional toner, which may be a colorless toner, comprises reactive components. The toners comprising one or more colorants are used to form an image on a substrate. The additional toner may be printed over, or under, the image, to cover the image as the image is printed on the substrate. The reactive components of the additional toner provide a base that covers at least the entire image to improve adhesion of the image layer with the final substrate, particularly where substrates having rough surfaces, such as textiles, are used as the final substrate.

U.S. Pat. No. 7,654,660 B2 to Hale et al. discloses reactive inks and methods of generating an image on a substrate using both reactive and heat activated inks. An image is printed on a substrate, without reacting the reagents in the ink. Subsequently, the reagents are reacted to fix the image to a substrate, with substantial permanency and fastness. Sublimation or similar heatactivated syes are printed on the substrate. The sublimation or similar heat activated dyes are activated, and have an affinity for polymer that is applied to the substrate.

U.S. Pat. No. 7,749,581 B2 to Dalvey et al. discloses an image transfer sheet. The image transfer sheet comprises a release layer and a polymer layer. One or more of the release layer and the polymer layer comprise titanium oxide or other white pigment.

U.S. Pat. No. 7,766,475 B2 to Dalvey et al. discloses an image transfer sheet. The image transfer sheet comprises a release layer and a polymer layer. One or more of the release layer and the polymer layer comprise titanium oxide or other white pigment.

U.S. Pat. No. 7,771,554 B2 to Dalvey et al. discloses an image transfer sheet. The image transfer sheet comprises a release layer and a polymer layer. One or more of the release layer and the polymer layer comprise titanium oxide or other white pigment.

U.S. Reissued Pat. No. RE41,623 E to Schwendimann et al. discloses an image transfer sheet. The image transfer sheet comprises a release layer and a polymer layer. One or more of the release layer and the polymer layer comprise titanium oxide or other white pigment.

U.S. Pat. No. 7,943,214 B1 to Bamberg et al. discloses an ink-jet transfer system, as well as a transfer printed product which is highly wash-resistant, color-fast, and environmentally friendly, and a process for producing the same and its use in a printing process by means of the disclosed ink-jet transfer system. The disclosed ink-jet transfer system has a substrate, a hot-melt layer applied on the substrate and at least one ink-absorbing layer which comprises a mixture of a highly porous pigment and a binder. The molecules of the pigment and if required of the binder and hot-melt layer can form chemical bonds with the dying molecules of the ink.

Many of the transfer media described in the literature are in the form of a sheet of transfer paper. A disadvantage of many of these transfer papers is that when the transfer is effectuated, an entire surface layer of the transfer paper (including areas which do not contain a design) is transferred to the article. This results in an inferior final product, due to the fact that the transfer media adheres to the article in places outside the printed design. One method used to overcome this problem is to cut away parts of the transfer media that do not contain a printed design. Another method is to neutralize areas of the transfer media that do not contain a printed design. Recently, forms of "self-weeding" transfer media have been produced that eliminate the need to neutralize the non-printed areas of the transfer media, yet still only transfer the portion of transfer media on which a design is printed. Examples of such self-weeding transfer paper include TRANSGLOSS® produced by One Step Papers of Miami, Fla. (http://www.onesteppapers.com), FOREVER No-Cut produced by FOREVER Gmbh of Heddesheim, Germany (http://www.forever-ots.com), and Free Style by Modern Transcopy (http://www.mtct.de/Free_eng__2010.pdf).

As used in the application, "transfer sheet" and "transfer paper" both refer to a medium on which a design is temporarily printed, before being transferred to an article. The materials from which the transfer sheet or transfer paper are made do not change the meaning of these terms.

United States Patent Application Publication No. 2010/0089525 A1 to Krozner discloses a method of forming an opaque image on a substrate. The method generally includes the use of three papers: a toner printable sheet, a coating transfer sheet, and an opaque transfer sheet. Toner printing can be utilized to print an image on the toner printable sheet, and then the toner ink can be utilized to remove a portion of the melt coating layer from the coating transfer sheet to form an intermediate imaged coated transfer sheet and the opaque transfer sheet can then be utilized to form an image, defined by the opaque areas, on a substrate.

U.S. Reissued Pat. No. RE42,541 E to Dalvey et al. discloses a method for transferring an image from one substrate to another. The method includes providing an image transfer sheet that is comprised of a substrate layer, a release layer and an image-imparting layer that may comprise a low density polyethylene or other polymeric component having a melting temperature within a range of 90°-700° C. An image is imparted to the low density polyethylene area with an image-imparting medium. A second image-receiving substrate is contacted to the first image transfer sheet at the polymer layer. Heat is applied to the image transfer sheet so that the low density polyethylene encapsulates the image-imparting medium and transfers the encapsulates to the image-receiving substrate, thereby forming a mirror image on the image-receiving substrate.

U.S. Pat. No. 8,029,883 B2 to Xu et al. discloses a transfer medium for receiving images formed on the medium by inks or toners comprising thermally diffusible colorants, including disperse dye and sublimation dye, and methods of using the medium to present images on substrates. The medium provides an opaque layer that allows transfer of the image from the medium to a substrate, and provides a background for the image when the image is transferred to a dark colored substrate, so that the dark colored substrate does not obscure the image.

U.S. Pat. No. 8,172,974 B2 to Krozner discloses methods and products for forming a coated image on a substrate. The methods can include forming an image on a printable surface of a transfer coating layer of a printable transfer sheet. In a separate step, the negative mirror image of that same image is printed with toners on a toner printable sheet. After registering the sheets together, a portion of the transfer coating layer of the printable transfer sheet is transferred to the toner printable sheet, such that the portion of the transfer coating layer transferred to the toner printable sheet corresponds to the imaged areas on the toner printable sheet. However, the image formed on the printable surface of the transfer coating layer and the underlying transfer coating substantially remain on the printable transfer sheet. Thereafter, the image and the transfer coating layer remaining on the printable transfer sheet are transferred to a substrate.

SUMMARY OF THE INVENTION

The present invention provides a method of transfer printing that is economical, fast, and easy to execute.

One embodiment of the invention is a method including the steps of supplying a self-weeding transfer paper, printing a design on the self-weeding transfer paper using sublimation dye, printing white toner over at least a portion of the design, placing the self-weeding transfer paper on an article, and applying heat and pressure to transfer the design and the white toner to an article.

In some embodiments of the invention, a polymer coating is applied over at least a portion of the design, which can be a full-color design. In some embodiments of the invention, the article to which the design and white toner are applied is a textile article.

In some preferred embodiments of the invention, the article to be transfer printed is a dark textile article. The present invention method, due to the use of white toner to provide a background for sublimation or disperse dyes, particularly those with a light color, is particularly well-suited to use with dark textile material, such as that used in clothing or upholstery.

Another embodiment of the invention is a method including the steps of supplying a self-weeding transfer paper and printing a design on the self-weeding transfer paper using an electrostatic printing device. The electrostatic printing device is adapted to receive at least one sublimation dye toner cartridge. The at least one sublimation dye toner cartridge contains a sublimation dye toner. Additional steps in this embodiment of the invention include replacing the at least one sublimation dye toner cartridge with a white toner cartridge containing white toner and printing white toner over at least a portion of the design using the electrostatic printing device.

In some embodiments of the invention, the electrostatic printing device is adapted to receive at least four sublimation dye toner cartridges. In some embodiments of the invention, each of the at least four sublimation dye toner cartridges is replaced with a white toner cartridge.

In some embodiments of the invention, the method further includes the steps of supplying a computer loaded with software for creating an image of the design and electronically sending the image from the computer to the electrostatic printing device to print the design. In some embodiments, the software loaded on the computer is used to invert the colors of the image before the step of printing white toner over at least a portion of the design.

Another embodiment of the invention is a method including the steps of supplying a self-weeding paper, printing a design on the self-weeding paper using an ink-jet printing device that is adapted to receive at least one sublimation dye ink-jet cartridge; the at least one sublimation dye ink-jet cartridge contains sublimation dye. Additional steps in this embodiment include placing the self-weeding transfer paper in an electrostatic printing device having at least one toner cartridge containing white toner and printing white toner over at least a portion of the design using the electrostatic printing device.

In some embodiments of the present invention method, the electrostatic printing device has at least four toner cartridges containing white toner.

In some embodiments of the present invention, the method further includes the steps of supplying a computer loaded with software for creating an image of the design, electronically sending the image from the computer to the ink-jet printing device to print the design. An additional step in some embodiments of the invention, which occurs before the step of printing white toner over at least a portion of the design, is using computer software to invert the colors of the image.

The present invention also includes the products produced by all embodiments of the present invention method.

DETAILED DESCRIPTION OF THE EMBODIMENTS

Figure 1:
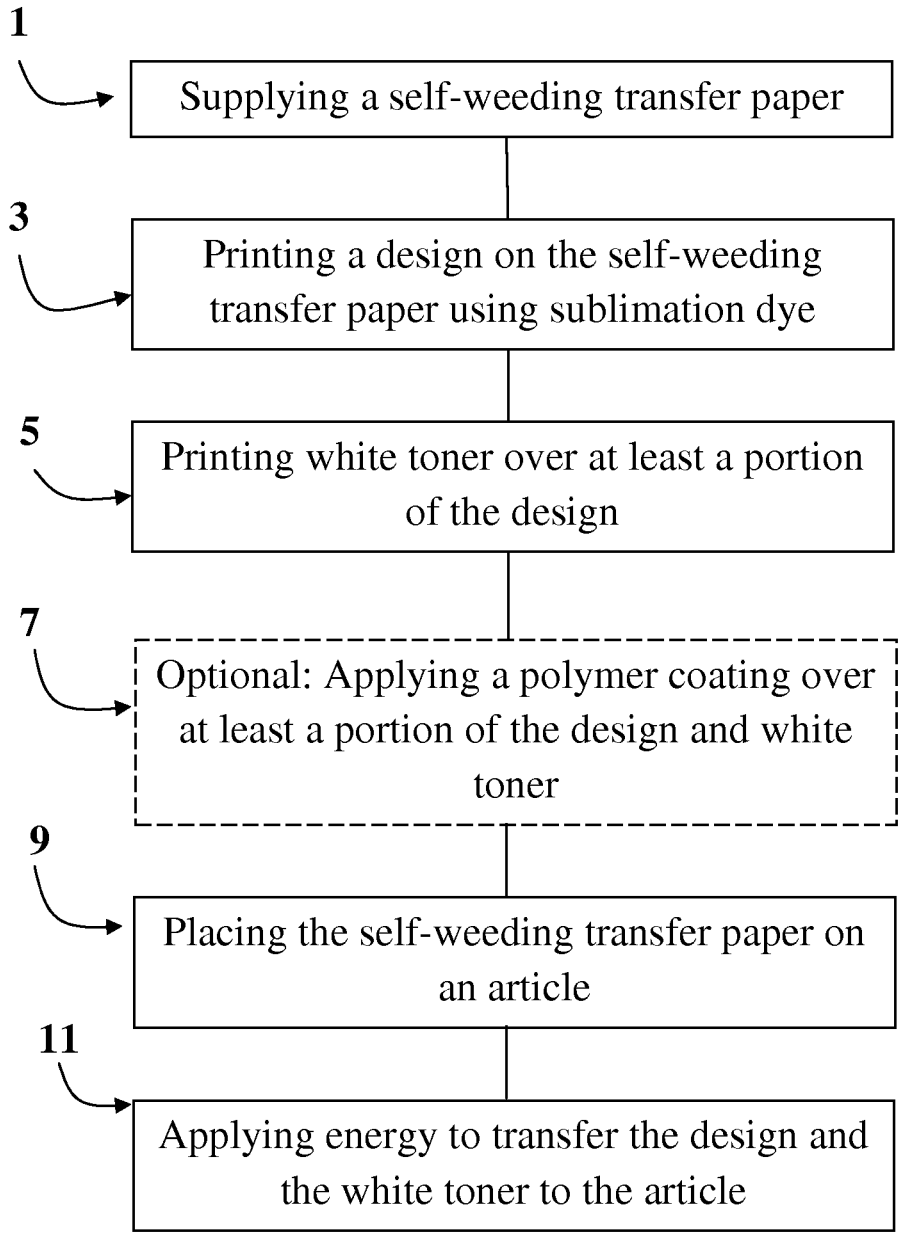
FIG. 1 is a block diagram showing one embodiment of the present invention method.

The following description of various embodiments of the invention is provided for the purpose of explanation and illustration. The invention is not limited to the embodiments described herein, and a person having skill in the art will appreciate that the invention includes all reasonable equivalents to the embodiments described herein.

In some embodiments, the invention includes a method of transfer printing onto an article. This method of transfer printing employs transfer paper, a design printed using sublimation dye printed onto the transfer paper from any suitable device, and white toner printed over at least a portion of the design printed using sublimation dye.

It is desirable to use sublimation dyes to create the design because traditional non-sublimation pigmented toners and inks do not produce the same quality product as sublimation dyes. When traditional pigments are heated with a white toner background, the pigments tend to blend with the white toner. This can result in muted colors (e.g. colors that should appear bright red in the final design may be muted to a pink color). Sublimation dyes, when heated, will outgas onto or into the surface of the white toner and will result in a product with much more vibrant colors.

The sublimation dye is printed onto the transfer paper using traditional printing methods. This can include, for example, electrostatic printing devices such as laser and LED printers, xerographic copiers, and the like. It can also include all varieties of ink-jet printers. Both black-and-white and color printing devices are contemplated by the present invention method. A wide variety of commercially-available printers can be used with the present invention method. The specifics of printer operation are well known in the art and will not be discussed herein at length, except where applicable to the discussion of the invention herein disclosed.

In some preferred embodiments of the invention, a computer in electronic communication with the printer is used. This computer will preferentially be equipped with software that allows for the creation of an image capable of being printed as a design by the printer. The image created by the computer can be any variety of image, including but not limited to text, photographs, graphs, tables, clip art, and the like.

In some preferred embodiments, the computer will also be preferentially equipped with software that can take an image and invert the color palette of that image. To invert the color palette of an image means to create a negative image of the original image, so that, for example, pure black in the original image appears as pure white in the negative image. Colors will also be inverted, such that a dark blue in the original image may appear as a light orange in the negative image. There are a variety of color inversion methods available using modern computer technology, such as RGB-Inversion and RYB-inversion. It is also possible to convert the colors in an image from RGB mode to HSL, HSB, or HSI mode using a computer, then invert the hue value of the image, and convert the image back to RGB mode. Different methods of inversion may result in a variety of different negative images being produced, but the manner in which the image is inverted is not critical to the invention.

Attention is drawn to the accompanying drawings, in which like reference numerals indicate identical elements. The drawings accompanying the application are for illustrative purposes only. Nothing in the drawings should be construed to limit the scope of the present invention as claimed.

Turning now to FIG. 1, one embodiment of the present invention method is shown. A self-weeding transfer paper is supplied 1. As used herein, the term self-weeding means that non-imaged areas of the transfer sheet are not transferred to the article, even upon the application of sufficient heat and pressure to transfer the design and white toner. In embodiments of the present invention method in which a self-weeding paper is used, any type of self-weeding paper can be used, such as those commercially available. However, in preferred embodiments, a one-step self-weeding transfer paper is used. One-step self-weeding transfer papers do not require an intermediate step in which non-imaged areas of the transfer paper are neutralized (through, for example, exposure to radiation or chemicals) to prevent transfer. In preferred embodiments, this self-weeding transfer paper is provided in sheet form of a size that fits into standard, commercially-available printers.

A design is printed 3 on the self-weeding transfer paper using one or more sublimation dyes. In alternative embodiments, disperse dyes can be used in place of the sublimation dyes or in addition to the sublimation dyes. Sublimation dyes are preferable to pigments, particularly in embodiments using a white toner background, because pigments tend to blend with the white toner when heated, causing the colors of the resulting design to appear muted, as compared to the original image. Sublimation dyes, on the other hand, retain a bold and vibrant appearance, even when heated with a white toner.

One having skill in the art will appreciate that many transfer papers, including self-weeding transfer papers, will transfer a design onto an article that is a mirror image of the design printed on the transfer paper. When using a transfer paper that transfers a mirror image, it is necessary to create a design on the transfer paper that is the mirror image of the desired design so that when the design is transferred to the article, it will possess the correct orientation.

In embodiments using sublimation dyes in a printer, it is not necessary for pure sublimation dye to be used. In preferred embodiments which use an electrostatic printer having dry toner, the sublimation dye is formulated with other components, such as a dry powdered resin, to create a sublimation dye toner. The sublimation dye toner allows the sublimation dye to be effectively printed from the electrostatic printer. In still other preferred embodiments, the other components in the sublimation dye toner may impart other beneficial properties to the sublimation dye or to the finished product. For example, in some embodiments, the dry powdered resin is made from a polymer onto which the sublimation dye can adhere.

Likewise, in preferred embodiments which use an ink-jet or other printer having wet toner, the sublimation dye can be suspended or dissolved in a carrier to create a sublimation dye ink. In some preferred embodiments, the carrier contains other components besides the sublimation dye; these other components can impart other beneficial properties to the sublimation dye or to the finished product. For example, in some embodiments, the sublimation dye ink can contain components which prevent the nozzle of an ink-jet printer from clogging.

Continuing with a discussion of FIG. 1, white toner is printed 5 over at least a portion of the design. In preferred embodiments of the invention, the area printed with white toner will be in superimposed registration with the design printed using the sublimation toner. This white toner can be of any commercially-available type. However, in preferred embodiments, the white toner contains both organic and inorganic components. In some preferred embodiments, the white toner contains not more than 45% inorganic components.

In some embodiments of the present invention method, the white toner can be printed in a substantially uniform coat over the entire design. However, in more preferred embodiments, the white toner is not printed in uniform thickness, but rather is applied more heavily to areas of the design having a lighter color. Thus, one having skill in the art will appreciate that in areas of the design which are intended to be white, a large amount of white toner will be applied; areas of the design which are to appear as black or as a very dark color will tend not to be obscured by the dark color of the article as significantly as areas of the design which are intended to be a light color. Thus, areas of the design which are to appear as a dark color or as black will need very little white toner applied, and in some cases will not need to have white toner applied at all.

In some embodiments, after the design and the white toner have been printed onto the self-weeding paper in superimposed registration with one another, an optional step of applying 7 a polymer coating over at least a portion of the design and white toner is included. In embodiments which include this step, the polymer coating can help adhere the design and the white toner to the article. Additionally, in embodiments using this step, the polymer coating can provide an additional substrate onto which the sublimation dye can adhere. In some embodiments, an additional polymer coating is not used. In some embodiments, the weed-free transfer paper has a polymer layer that can provide some of the same benefits as the optional polymer coating.

Once the design and the white toner have been printed onto the self-weeding transfer paper in superimposed registration with one another, the self-weeding transfer paper containing the design and the white toner is placed 9 onto an article. One having skill in the art will appreciate that in embodiments which do not use a one-step self-weeding transfer paper, any steps (not shown) to neutralize the non-imaged areas of the self-weeding transfer paper, thereby preventing transfer of non-imaged areas, will have to be completed before the self-weeding paper is placed 9 onto an article. One having skill in the art will understand that the self-weeding transfer paper should be placed on an article in such a way that the design can be properly transferred to the correct location on the article.

One having skill in the art will also appreciate that it may be desirable to print an all-white image onto a dark article. In some embodiments of the present invention, a white toner is printed directly onto the self-weeding transfer paper, without first printing any design using sublimation dyes.

Once the self-weeding transfer paper is placed 9 on the article, energy is applied 11, causing the design printed in sublimation toner and the white toner to be transferred to the article. In preferred embodiments, the energy applied is in the form of heat and pressure. Any suitable method of applying the appropriate heat and pressure can be used. In some preferred embodiments, a heat press is used to apply the appropriate heat and pressure. One having skill in the art will understand that the appropriate heat and pressure, and the length of time for which the heat and pressure are applied, may vary based on a variety of factors, including but not limited to: the nature of the transfer paper, the composition of the sublimation dye formulation, the composition of the white toner, the amount of sublimation dye applied, the amount of white toner applied, the nature of the article being transfer printed, and the temperature and humidity of the environment in which the heat and pressure are being applied.

In some preferred embodiments in which a heat press is used, the temperature of the heat press is preferably between 250° F. and 400° F., although temperatures outside this range may also be functional. In preferred embodiments, a pressure in the range of 10 to 80 pounds per square inch (psi) is applied to the combination of the self-weeding paper and the article. In preferred embodiments, the temperature and pressure are applied for more than 5 seconds. In more preferred embodiments, the temperature and pressure are applied for a period of time between 5 seconds and 60 seconds. In still more preferred embodiments, the heat and pressure are applied for between 10 seconds and 30 seconds.

Normally, disperse and sublimation dyes require a temperature of about 375° for approximately 40 seconds to completely activate. One advantage of the present invention method is that, when white toner is applied in superimposed registration with a design printed using sublimation or disperse dyes, the period of time required for this transfer is significantly reduced.

Figure 2:
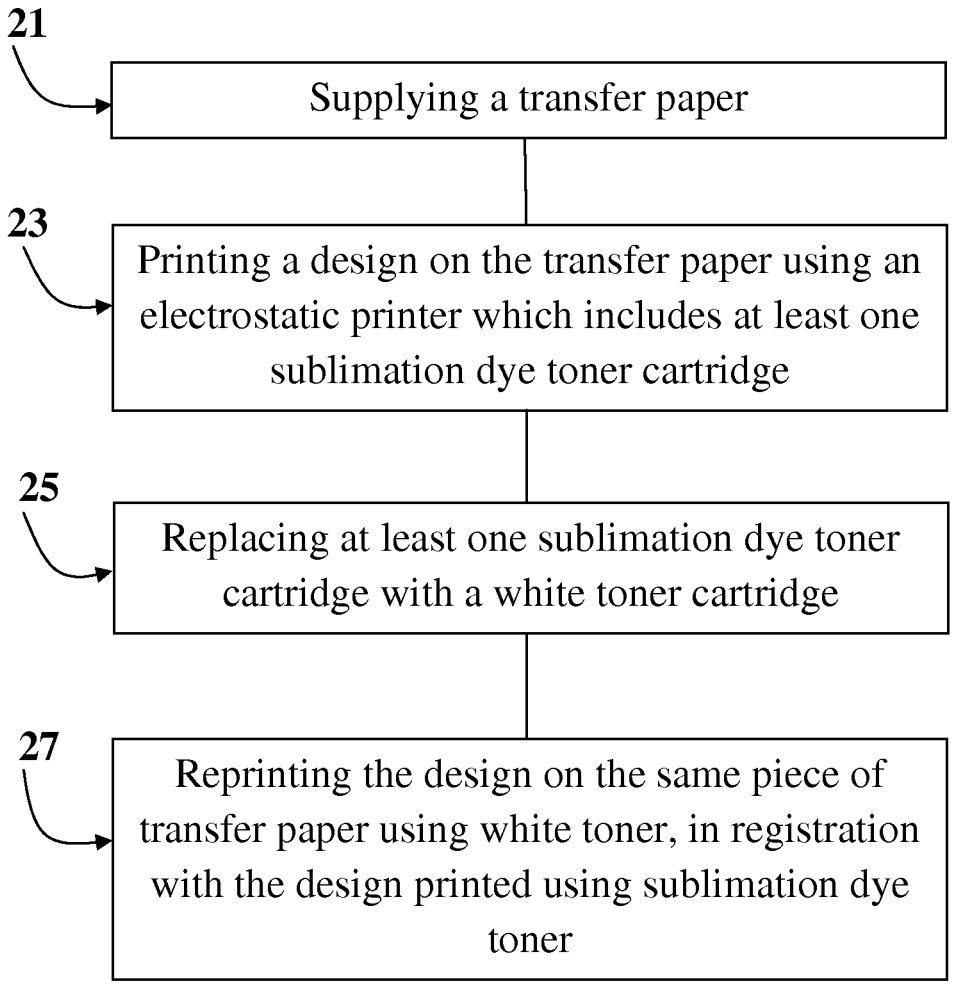
FIG. 2 is a block diagram showing another embodiment of the present invention method.

Turning now to FIG. 2, another embodiment of the present invention method is shown. A transfer paper is supplied 21. For the embodiments shown by FIG. 2., any form of transfer paper is acceptable, including non-weeding transfer papers. However, in preferred embodiments, a weed-free transfer paper is used. In still more preferred embodiments, a one-step weed free transfer paper is used.

A design is printed 23 onto transfer paper using an electrostatic printing device. Electrostatic printing devices include laser and LED printers. Many printers of this type use a dry toner that is attracted to the paper (or other material to be printed) via an electrostatic charge and then fused onto the paper at that location using a headed fuser, such as a drum. In some embodiments of the present invention, an electrostatic printing device is loaded with at least one sublimation dye toner cartridge containing a formulation having at least some sublimation dye in solid form.

Electrostatic printers that print only black toner generally have only one print cartridge, which contains black toner. Color electrostatic printers are usually equipped with at least four toner cartridges (magenta, cyan, yellow, and black), but may have five, six, or even more. In a standard printer, these cartridges contain a pigmented toner. While some embodiments of the present invention are functional with pigmented toner, more preferred embodiments use a sublimation dye toner. Pigmented toners have a tendency to mute out when heated with white toner, such that, for example, dark blue may become light blue and dark red may turn pink. Thus, in the more preferred embodiments of the present invention, each of the pigmented toner cartridges are replaced with a sublimation dye toner cartridge having a sublimation dye that is capable of producing colors similar to those created by pigmented toners, but without any problem with muting at the temperatures associated with the transfer process.

Returning to the embodiment shown in FIG. 2, after the transfer paper is printed with the sublimation dye toner, at least one of the print cartridges in the electrostatic printer is replaced 25 with a white toner cartridge. This step provides a variety of advantages over other methods of transfer printing. One major advantage is that by replacing the cartridge in this manner, only one printer is needed. Laser and LED printers can be very expensive, so being able to complete all printing aspects of the present invention method on one printer is more economical, and lowers at least one barrier to entry for those interested in transfer printing. In fact, any person that already has an electrostatic printer could use this embodiment of the present invention method, provided that both sublimation dye toners and white toners were made to fit that model of commercially-available printer.

Again turning to the embodiment shown in FIG. 2, after replacing 25 the sublimation dye toner cartridge with the white toner cartridge, the design is reprinted 27 onto the same piece of transfer paper (which has been loaded back into the same printer) in superimposed registration with the design printed by the sublimation dye toner.

Yet another advantage of replacing the sublimation dye toners cartridges with white toner cartridges is that it saves the user time. By essentially "tricking" the printer into printing with a white toner formulation when it thinks it is printing in a different color (including black), very few changes need to be made to the digital image on the computer. If every sublimation dye toner cartridge in the printer is replaced with a white toner cartridge, upon printing the exact same image from the computer onto the same transfer sheet, the entirety of the design created by the sublimation dye toner will be covered by the white toner in superimposed registration.

In some embodiments of the present invention method, color electrostatic printing devices are used. As stated above, color electrostatic machines generally have four or more toner cartridges. In some preferred embodiments of the present invention, every single print cartridge receptacle will have a sublimation dye toner cartridge with a color corresponding to the color of the pigmented toner in the cartridge usually found in that receptacle (when, for example, the printer is first used after being bought from the manufacturer). In some preferred embodiments, after the design is printed 23 using the sublimation dye toner, every one of the those sublimation dye toner cartridges will be removed and replaced by a white toner cartridge. Another advantage of the present invention method is that often (though not always), different print cartridges (e.g. magenta and cyan) within the same electrostatic printer are the same size and shape. This would allow users of the present invention method to buy white toner for a particular printer in bulk, and then use the white toner in any of the toner cartridge receptacles in the printer. Again, in these embodiments, the advantage exists that the printer is "tricked" into thinking it is printing a full color design, but in fact, it is reprinting the entire design in white in superimposed registration with the design printed using sublimation dye toner.

Figure 3:
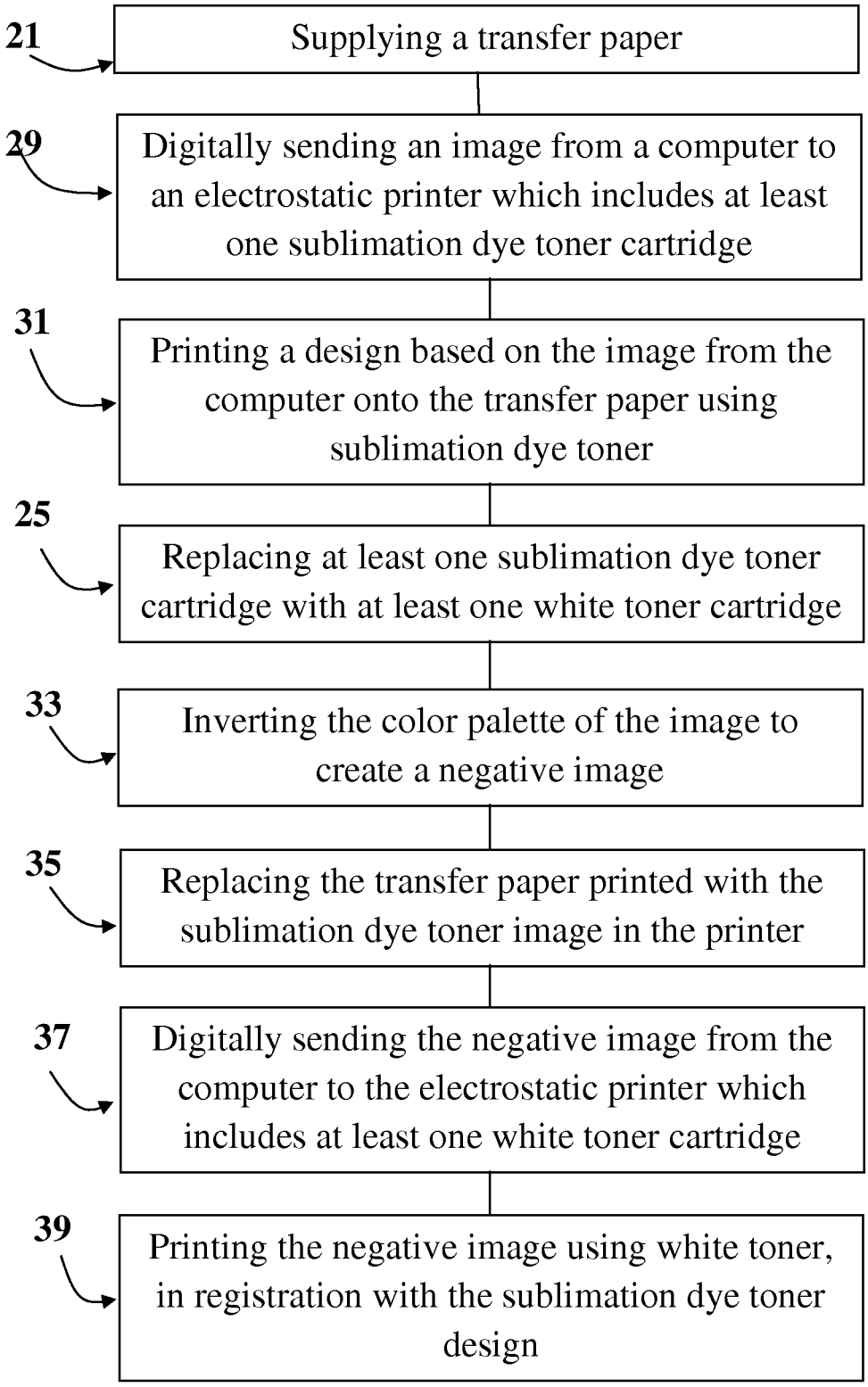
FIG. 3 is a block diagram showing another embodiment of the present invention method.

Turning now to the embodiment shown in FIG. 3, a transfer paper is supplied 21. Although this can be any type of commercially available transfer paper, it is preferably a weed-free transfer paper, and more preferably a one-step weed-free transfer paper.

An image is digitally sent 29 from a computer to an electrostatic printer which includes at least one sublimation dye toner cartridge. In preferred embodiments of the present invention method, a computer is used to aid the creation of an image that will be printed as a design and transferred to an article. Throughout this application, an effort has been made to refer to electronic data that can be displayed on a monitor as a picture, text, etc. as an "image." Throughout the application, where the word "design" is used as a noun, it is intended to refer to a printed picture, text, etc. However, where context clearly indicates a different usage, the word should be read in its context.

Although preferred embodiments of the present invention method include a computer for making an image that will be sent to the printer to be printed as a design, other embodiments do not include a computer. For example, some digital printers today are equipped with USB ports or have ports that can accept memory cards containing images. Such printers can print directly from the memory inserted into one of these ports without the need for a computer. Also, a printer could be directly connected to a recording device, such as a digital camera or a drawing tablet, and would print as soon as data was input and sent to the printer.

Turning again to FIG. 3, once the image has been digitally sent 29, a design based on the image from the computer is printed 31 onto the transfer paper using sublimation dye toner. Once the design has been printed 31, at least one of the sublimation dye toner cartridges is replaced 25 with a white toner cartridge. As explained above, in some embodiments of the present invention, every single one of the sublimation dye toner cartridges is replaced with a white toner cartridge.

In some other embodiments of the present invention method, when a computer is used, it is not necessary to replace each of the sublimation dye toner cartridges with a white toner cartridge. Rather, the user may choose to replace only the black toner cartridge, regardless of how many color toner cartridges are present. In these embodiments, the user of the computer must take the additional step of converting color images to grayscale before printing using the white toner. For embodiments in which the image is converted to grayscale, the printer will only print using the cartridge in the black toner receptacle, and thus, only that cartridge would need to be replaced.

In the embodiment shown in FIG. 3, another important step in the present invention method is described. In some embodiments, at some point before the white toner is printed, the user of a computer can invert 33 the color palette of the image on the computer. As discussed above, in preferred embodiments of the present invention, the white toner is not applied with uniform thickness to the design printed using the sublimation dye toner. Rather, the white toner is applied more heavily to areas of the design having a lighter color, and more lightly (or not at all to areas having dark color). By inverting the color pallete and exchanging the print cartridges, the printer is "tricked" into printing a large amount of white toner over areas of the design that are lighter, and will print less white toner over areas of the design that are darker. In embodiments in which the color palette of the image is inverted to create a negative image, it is important that the software used to create the image can differentiate between parts of the image that are white, and parts of the image that are transparent. Generally, any part of the image that will be a white part of the final transferred design should be designated as white. Any part of the image that will not appear on the final transferred design should be designated as transparent. That way, when the image is inverted, the parts that were white will become black, and therefore will be printed heavily in white onto the transfer paper by the printer that has been tricked. The parts that were transparent (generally the parts outside the boundaries of the desired design) will remain transparent when the image is inverted, and therefore will not be printed in white. Failure to designate transparent parts of the image could cause the entire area of the transfer paper to be printed in white, which would defeat the purpose of the self-weeding paper and would result in the transfer of a sheet-of-paper-sized white rectangle to be transferred to the article.

At some point after the design is printed onto the transfer paper using the sublimation dye toner, the transfer sheet is reloaded 35 into the printer paper tray or other paper receptacle with the same orientation it had for the first printing. This will allow the white toner printing to be in essentially superimposed registration with the sublimation dye toner image, although due to the inversion of the color palette, the white toner will not be laid down in precisely the same places and amounts as the sublimation dye toner.

After the color palette of the image on the computer has been inverted 33, and the transfer paper containing the design printed from sublimation dye toner has been reloaded 35, the negative image from the computer is digitally sent 37 from the computer to the electrostatic printer, which now contains at least one white toner cartridge. The negative image is then printed 39 using white toner, essentially in superimposed registration with the sublimation dye toner design.

Figure 4:
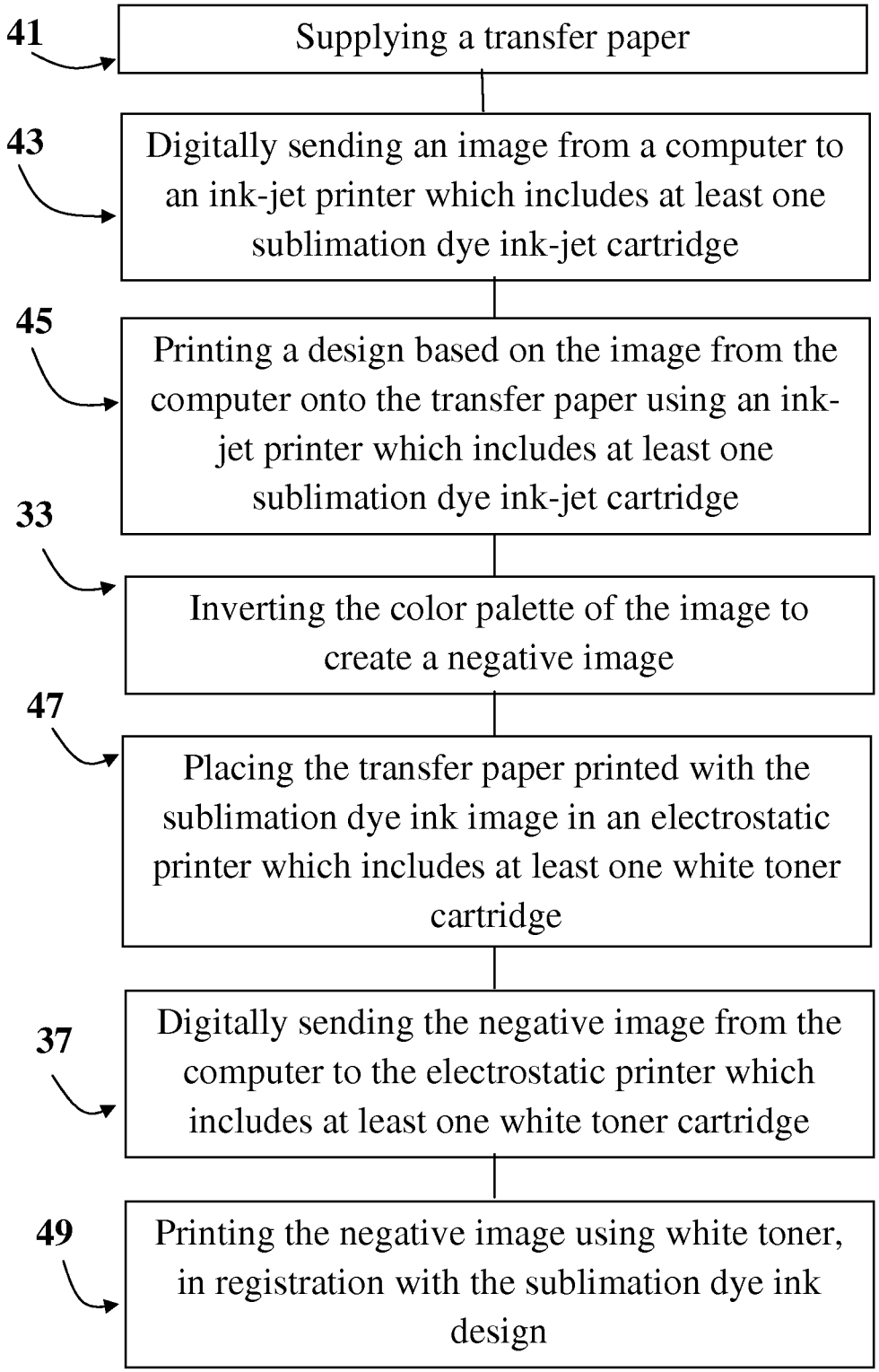
FIG. 4 is a block diagram showing another embodiment of the present invention method.

Turning now to FIG. 4, another embodiment of the present invention is shown. A transfer paper is supplied 41. In some embodiments, the transfer paper is any type of transfer paper, including non-weeding transfer paper. In more preferred embodiments, the transfer paper is a self-weeding paper. In still more preferred embodiments, the transfer paper is a one-step self-weeding transfer paper. In yet more preferred embodiments, the transfer paper is specifically formulated for use with ink-jet sublimation dyes. In these yet more preferred embodiments, the ink jet transfer paper contains a receiver coating to accept wet sublimation ink, and yet is designed to withstand the temperatures (in excess of 400° F.) associated with the fuser roller of the electrostatic printing device used in connection with the white toner.

In some embodiments of the present invention method, an image is digitally sent 43 from a computer to an ink-jet printer which includes at least one sublimation dye ink-jet cartridge. Unlike electrostatic printers, which have many models still produced in monochrome (black & white), most ink-jet printers used today have the capacity to print color. In some embodiments of the present invention method, only the black ink-jet cartridge is replaced, which would require that all images printed using the sublimation dye ink would have to be in black and white. In more preferred embodiments, the color ink-jet cartridges are also replaced with sublimation dye ink-jet cartridges, making the printing of full-color designs possible with sublimation dye ink. Unlike most electrostatic printers, ink jet printing devices generally use wet inks, and therefore formulations using sublimation dye must be adapted to work with ink-jet printers.

A design based on the image sent 43 from the computer is printed 45 onto the transfer paper using an ink-jet printer which includes at least one sublimation dye ink-jet toner cartridge. As stated above, preferred embodiments of the present invention method use a transfer paper which has a receiver coating to accept the wet sublimation ink.

In preferred embodiments of the invention, after the image is digitally sent 43 from the computer, a user inverts 33 the color palette of the image to create a negative image. The advantages of creating a negative image prior to printing are described above reference to FIG. 3, and are incorporated herein by reference.

In preferred embodiments, once the transfer paper has been printed with the design using sublimation dye ink, the transfer paper is placed in an electrostatic printer which includes at least one white toner cartridge. The transfer paper should be inserted into the electrostatic printer in such a way that the white toner is printed over the design essentially in superimposed registration with the design (although as discussed above, the inversion of the image may cause the deposition of white toner in a different arrangement or in a different thickness than the sublimation dye ink). By "essentially in superimposed registration" it is meant that the images are printed on the same side of the transfer paper, in the same orientation, in approximately the same location. Particularly where the computer image has been inverted, strict superimposed registration is not required, and does not even provide as good a result as when the white toner is printed heavily over the light areas and lightly over the dark areas.

In addition to the methods described and claimed herein, the invention also includes any articles of manufacture that result from the processes described and claimed. Furthermore, although an effort has been made to describe representative embodiments of the invention, other embodiments of the invention fall within the spirit and scope of the invention as herein claimed and described, and will be apparent to one having skill in the art.

What is claimed is:

1. A method of transfer printing comprising the steps of:

supplying a transfer paper;

printing a design on said transfer paper using sublimation dye;

printing white toner over at least a portion of said design;

placing said transfer paper on an article; and applying heat and pressure to transfer said design and said white toner to said article.

2. The product produced by the method of claim 1.

3. The method of transfer printing of claim 1, further comprising the step of applying a polymer coating over at least a portion of said design.

4. The method of transfer printing of claim 1 wherein said design is a color design.

5. The method of transfer printing of claim 1 wherein said article is a dark textile article.

6. A method of making a printed transfer sheet comprising the steps of:

supplying a transfer paper;

printing a design on said transfer paper using an electrostatic printing device, said electrostatic printing device adapted to receive at least one sublimation dye toner cartridge, said at least one sublimation dye toner cartridge containing a sublimation dye toner;

replacing said at least one sublimation dye toner cartridge with a white toner cartridge containing white toner; and printing white toner over at least a portion of said design using said electrostatic printing device.

7. The method of making a transfer sheet of claim 6, wherein said electrostatic printing device is adapted to receive at least four sublimation dye toner cartridges.

8. The method of making a transfer sheet of claim 7, further comprising the step of replacing each of said at least four sublimation dye toner cartridges with a white toner cartridge.

9. The method of making a transfer sheet of claim 8, further comprising the steps of:

supplying a computer loaded with software for creating an image of said design;

electronically sending said image from said computer to said electrostatic printing device to print said design;

before the step of printing white toner over at least a portion of said design, using said software to invert the colors of said image to create a negative image; and electronically sending said negative image from said computer to said electrostatic printing device to print a negative design in white toner.

10. The product produced by the method of claim 9.

11. The method of making a transfer sheet of claim 10, further comprising the step of applying heat and pressure to transfer said design and said white toner to an article.

12. The method of making a transfer sheet of claim 11, wherein said article is a dark textile article.

13. The product produced by the method of claim 11.

14. A method of making a transfer sheet comprising the steps of:

supplying a transfer paper;

printing a design on said transfer paper using an ink-jet printing device, said ink-jet printing device adapted to receive at least one sublimation dye ink jet cartridge, said at least one sublimation dye ink-jet printer cartridge containing sublimation dye;

placing said transfer paper in an electrostatic printing device, said electrostatic printing device having at least one toner cartridge containing white toner; and printing white toner over at least a portion of said design using said electrostatic printing device.

15. The method of making a transfer sheet of claim 14, wherein said electrostatic printing device has at least four toner cartridges containing white toner.

16. The method of making a transfer sheet of claim 15, further comprising the steps of:

supplying a computer loaded with software for creating an image of said design;

electronically sending said image from said computer to said ink-jet printing device to print said design;

before the step of printing white toner over at least a portion of said design, using said software to invert the colors of said image to create a negative image; and electronically sending said negative image from said computer to said electrostatic printing device to print a negative design in white toner.

17. The method of making a transfer sheet of claim 16, further comprising the step of applying heat and pressure to transfer said design and said white toner to an article.

18. The method of making a transfer sheet of claim 17 wherein said article is a dark textile article.

19. The product produced by the method of claim 18.

* * * * *